US006499263B1

(12) United States Patent
Johnson

(10) Patent No.: US 6,499,263 B1
(45) Date of Patent: Dec. 31, 2002

(54) DECORATIVE WINDOW ASSEMBLY

(76) Inventor: Ruth Naomi Johnson, 412 E. 120th St., New York, NY (US) 10035

( * ) Notice: Subject to any disclaimer, the term of this patent is extended or adjusted under 35 U.S.C. 154(b) by 0 days.

(21) Appl. No.: 09/815,705

(22) Filed: Mar. 23, 2001

(51) Int. Cl.[7] ..... E06B 7/00

(52) U.S. Cl. ..... 52/311.1; 40/406; 40/439; 52/171.3

(58) Field of Search ..... 52/171.3, 311.1, 52/173.1; 40/406, 439; 428/38

(56) References Cited

U.S. PATENT DOCUMENTS

| | | | | | |
|---|---|---|---|---|---|
| 1,395,575 | A | | 11/1921 | Jarvis | |
| 3,205,118 | A | | 9/1965 | Guffan | |
| 3,638,342 | A | * | 2/1972 | Winslow et al. | 40/406 |
| 3,704,528 | A | * | 12/1972 | Lewis | 40/406 |
| 3,973,340 | A | * | 8/1976 | Khawand | 40/406 |
| 4,093,352 | A | | 6/1978 | Pisar | |
| 4,208,848 | A | | 6/1980 | Kohl | |
| 4,768,315 | A | * | 9/1988 | Grimme | 52/171.3 |
| 5,400,848 | A | | 3/1995 | Gainer | |
| 5,608,995 | A | | 3/1997 | Borden | |
| 5,617,657 | A | * | 4/1997 | Kahn | 40/406 |
| 5,655,589 | A | | 8/1997 | Vartanian | |
| 5,787,652 | A | | 8/1998 | Tai | |
| 5,791,078 | A | | 8/1998 | Maranto et al. | |
| 5,819,452 | A | * | 10/1998 | Hakkert | 40/406 |
| 5,989,666 | A | * | 11/1999 | Hadden | 52/311.1 |
| D420,307 | S | | 2/2000 | Sands | |

* cited by examiner

*Primary Examiner*—Michael Safavi

(57) ABSTRACT

A decorative window assembly for creating dazzling eye-catching designs in any room. The decorative window assembly includes a window frame with a window panel being securely mounted to the window frame. Tubular reservoir members are securely attached to the window frame and are adapted to store anti-freeze colored liquid. Decorative conduit members are disposed upon the window panel and are connected to the tubular reservoir members with tubular connectors. Pump members are connected to the tubular reservoir members for urging the anti-freeze colored liquid into the decorative conduit members and for drawing the anti-freeze colored liquid from said decorative conduit members.

6 Claims, 3 Drawing Sheets

DECORATIVE WINDOW ASSEMBLY

BACKGROUND OF THE INVENTION

1. Field of the Invention

The present invention relates to a design window panel and more particularly pertains to a new decorative window assembly for creating dazzling eye-catching designs in any room.

2. Description of the Prior Art

The use of a design window pane is known in the prior art. More specifically, a design window pane heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,093,352; U.S. Pat. No. 4,208,848; U.S. Pat. No. 5,400,848: U.S. Pat. No. 1,395,575; U.S. Pat. No. 3,205,118; Foreign Patent No. 0512136A1: and Foreign Patent No. 0465788A1.

While these devices fulfill their respective, particular objectives and requirements, the aforementioned patents do not disclose a new decorative window assembly. The inventive device includes a window frame; and also includes a window panel being securely mounted to the window frame; and further includes tubular reservoir members being securely attached to the window frame and being adapted to store anti-freeze colored liquid; and also includes decorative conduit members being disposed upon the window panel and being connected to the tubular reservoir members with tubular connectors; and further includes pump members being connected to the tubular reservoir members for urging the anti-freeze colored liquid into the decorative conduit members and for drawing the anti-freeze colored liquid from said decorative conduit members.

In these respects, the decorative window assembly according to the present invention substantially departs from the conventional concepts and designs of the prior art, and in so doing provides an apparatus primarily developed for the purpose of creating dazzling eye-catching designs in any room.

SUMMARY OF THE INVENTION

In view of the foregoing disadvantages inherent in the known types of design window panels now present in the prior art, the present invention provides a new decorative window assembly construction wherein the same can be utilized for creating dazzling eye-catching designs in any room.

The general purpose of the present invention, which will be described subsequently in greater detail, is to provide a new decorative window assembly which has many of the advantages of the design window pane mentioned heretofore and many novel features that result in a new decorative window assembly which is not anticipated, rendered obvious suggested, or even implied by any of the prior art design window pane, either alone or in any combination thereof.

To attain this, the present invention generally comprises a window frame; and also includes a window panel being securely mounted to the window frame; and further includes tubular reservoir members being securely attached to the window frame and being adapted to store anti-freeze colored liquid; and also includes decorative conduit members being disposed upon the window panel and being connected to the tubular reservoir members with tubular connectors; and further includes pump members being connected to the tubular reservoir members for urging the anti-freeze colored liquid into the decorative conduit members and for drawing the anti-freeze colored liquid from said decorative conduit members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new decorative window assembly which has many of the advantages of the design window pane mentioned heretofore and many novel features that result in a new decorative window assembly which is not anticipated, rendered obvious, suggested, or even implied by any of the prior art design window pane, either alone or in any combination thereof.

It is another object of the present invention to provide a new decorative window assembly which may be easily and efficiently manufactured and marketed.

It is a further object of the present invention to provide a new decorative window assembly which is of a durable and reliable construction.

An even further object of the present invention is to provide a new decorative window assembly which is susceptible of a low cost of manufacture with regard to both materials and labor, and which accordingly is then susceptible of low prices of sale to the consuming public, thereby making such decorative window assembly economically available to the buying public.

Still yet another object of the present invention is to provide a new decorative window assembly which provides in the apparatuses and methods of the prior art some of the advantages thereof, while simultaneously overcoming some of the disadvantages normally associated therewith.

Still another object of the present invention is to provide a new decorative window assembly for creating dazzling eye-catching designs in any room.

Yet another object of the present invention is to provide a new decorative window assembly which includes a window frame; and also includes a window panel being securely mounted to the window frame; and further includes tubular reservoir members being securely attached to the window frame and being adapted to store anti-freeze colored liquid; and also includes decorative conduit members being disposed upon the window pane and being connected to the tubular reservoir members with tubular connectors; and further includes pump members being connected to the tubular reservoir members for urging the anti-freeze colored liquid into the decorative conduit members and for drawing the anti-freeze colored liquid from said decorative conduit members.

Still yet another object of the present invention is to provide a new decorative window assembly that displays pattern designs in the room upon sunlight shining through the pattern designs.

Even still another object of the present invention is to provide a new decorative window assembly that allows the user to easily and conveniently display various designs upon window panels which would be displayed upon walls in a room.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
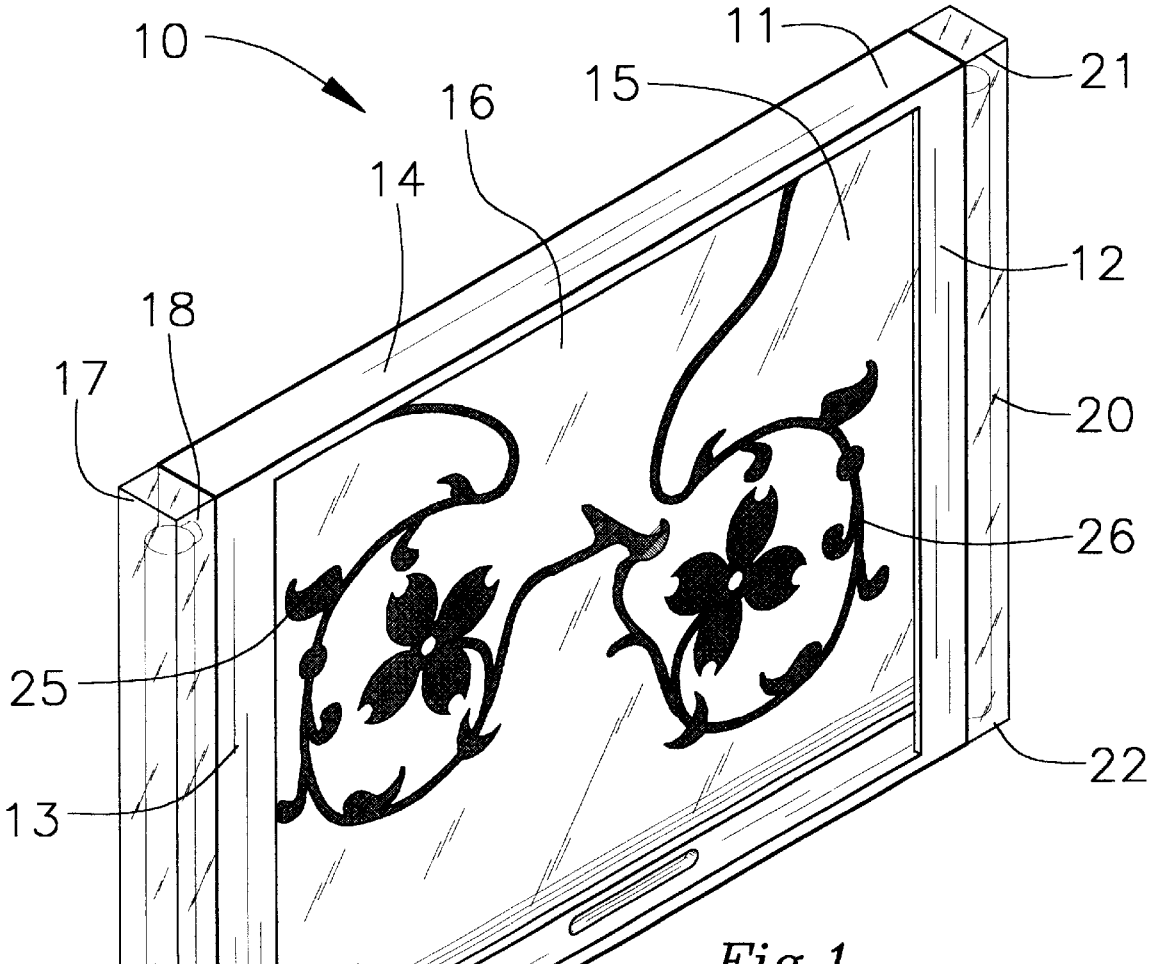
FIG. 1 is a perspective view of a new decorative window assembly according to the present invention with the window panel being shown in a lowered position.
Figure 2:
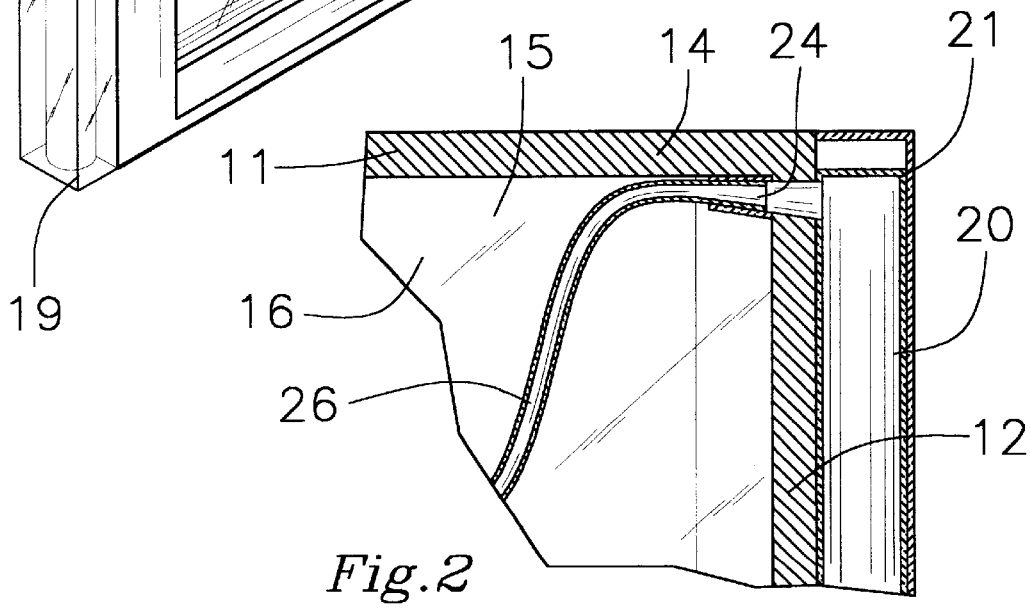
FIG. 2 is a partial cross-sectional view of the present invention.
Figure 3:
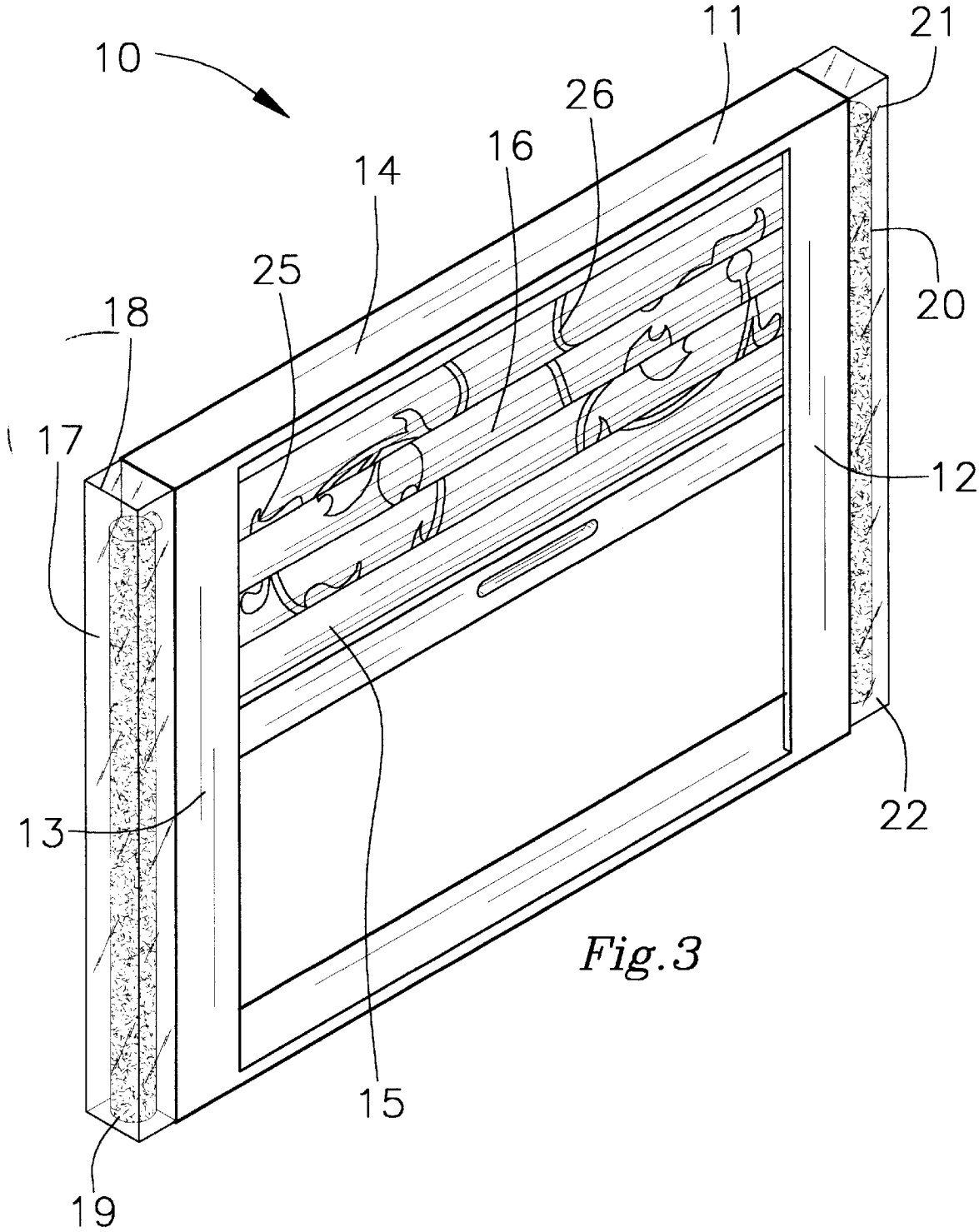
FIG. 3 is another perspective view of the present invention with the window panel shown in a raised position.
Figure 4:
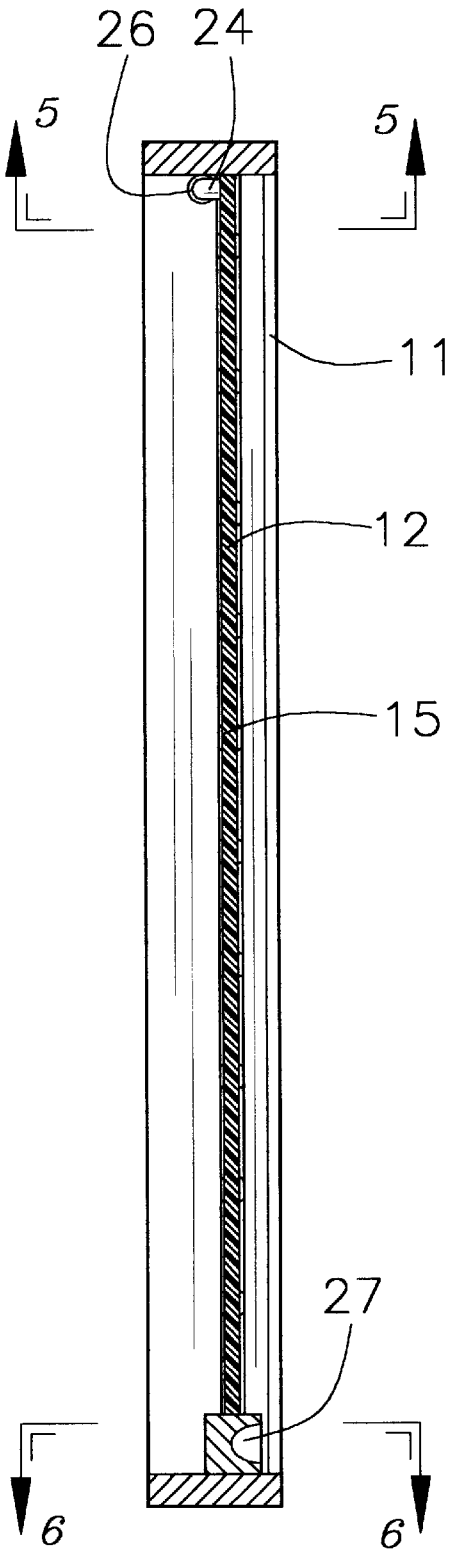
FIG. 4 is an side end elevational view of the present invention.
Figure 5:
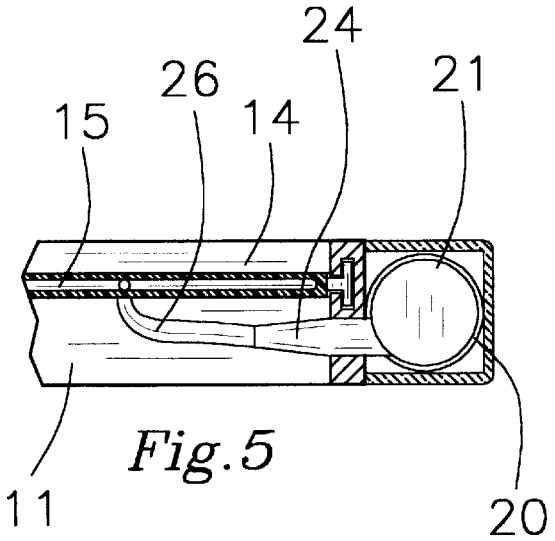
FIG. 5 is an upper cross-sectional view of one of tubular reservoir members of the present invention.
Figure 6:
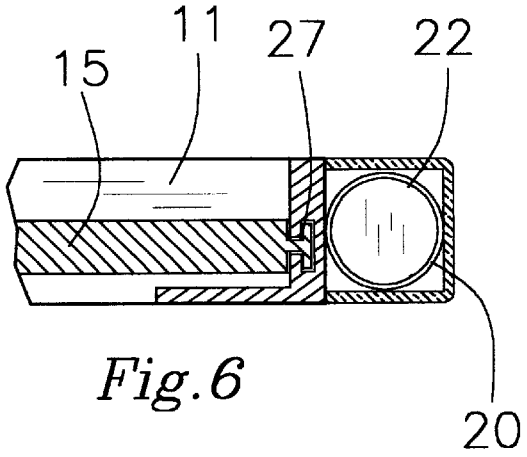
FIG. 6 is a lower cross-sectional view of one of the tubular reservoir members and one of the plunger members of the present invention.

With reference now to the drawings and in particular to FIGS. 1 through 6 thereof, a new decorative window assembly embodying the principles and concepts of the present invention and generally designated by the reference numeral 10 will be described.

As best illustrated in FIGS. 1 through 6, the decorative window assembly 10 generally comprises a window frame 11, and also comprises a window panel 15 being securely and conventionally mounted to the window frame 11 such that the panel is slidable in the frame between lowered (see FIG. 1) and raised (see FIG. 3) positions. Tubular reservoir members 17, 20 are securely and conventionally attached to the window frame 11 and are adapted to store anti-freeze colored liquid. The tubular reservoir members 17, 20 are vertically and conventionally disposed to either side of the window frame 11.

Decorative conduit members 25, 26 are conventionally disposed upon the window panel 15 and are conventionally connected to the tubular reservoir members 17, 20 with tubular connectors 24. The decorative conduit members 25, 26 are arranged in pattern designs including flowers, geometrical shapes, and any child-oriented themes. The decorative conduit members 25, 26 are made of vinyl material and are securely and conventionally attached upon a front side 16 of the window panel 15. The tubular connectors 24 are securely disposed at top corners of the window panel 15 and are extended through the window frame 11 and into the tubular reservoir members 17, 20 near top ends 18, 21 thereof. The tubular connectors 24 are securely and conventionally attached to an upper cross member 14 of the window frame 11.

Pump members 27 are conventionally disposed in the elongate side members 12, 13 of the window frame 11 and are conventionally connected to the tubular reservoir members 17, 20 for urging the anti-freeze colored liquid into the decorative conduit members 25. 26 and for drawing the anti-freeze colored liquid from the decorative conduit members 25, 26. The pump members 27 are generally piston/plunger members being conventionally disposed in the elongate side members 12, 13 of the window frame 11 and are conventionally connected to the tubular reservoir members 17, 20 and are adapted to urge the anti-freeze colored liquid from the tubular reservoir members 17, 20 into the decorative conduit members 25, 26 upon the window panel 15 being in a lowered position (see FIG. 1) and also being adapted to draw the anti-freeze colored liquid from the decorative conduit members 25, 26 into the tubular reservoir members 17, 20 upon the window panel 15 being moved into a raised position (see FIG. 3).

In use, the user attaches the particular pattern design of the decorative conduit members 25, 26 to the window panel 15 and connects the decorative conduit members 25, 26 to the tubular reservoir members 17, 20 with the tubular connectors 24. Upon the user closing the window panel 15, the anti-freeze colored liquid being stored in the tubular reservoir members 17, 20 is urged into the decorative conduit members 25, 26 by the pump members 27, and upon the user opening the window panel 15, the anti-freeze colored liquid is drawn back into the tubular reservoir members 17, 20 by the pump members 27.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intend to be encompass by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A decorative window assembly comprising:

a window frame;

a window panel being securely mounted to said window frame;

tubular reservoir members being securely attached to said window frame and being adapted to store anti-freeze colored liquid;

decorative conduit members being disposed upon said window panel and being connected to said tubular reservoir members with tubular connectors; and pump members being connected to said tubular reservoir members for urging the anti-freeze colored liquid into said decorative conduit members and for drawing the anti-freeze colored liquid from said decorative conduit members.

2. A decorative window assembly as described in claim 1, wherein said tubular reservoir members are vertically disposed to either side of said window frame.

3. A decorative window assembly as described in claim 2, wherein said decorative conduit members are arranged in pattern designs including flowers, geometrical shapes, and any child-oriented themes, said decorative conduit members being made of vinyl material and being securely attached upon a front side of said window panel.

4. A decorative window assembly as described in claim 3, wherein said tubular connectors are securely disposed at top corners of said window panel and are extended through said window frame and into said tubular reservoir members near top ends thereof, said tubular connectors being securely attached to an upper cross member of said window frame.

5. A decorative window assembly as described in claim 4, wherein said pump members are generally piston/plunger members being disposed in elongate side members of said window frame and being connected to said tubular reservoir members and being adapted to urge the anti-freeze colored liquid from said tubular reservoir members into said decorative conduit members upon said window panel being in a lowered position and also being adapted to draw the anti-freeze colored liquid from said decorative conduit members into said tubular reservoir members upon said window panel being in a raised position.

6. A decorative window assembly comprising:

a window frame;

a window panel being securely mounted to said window frame;

tubular reservoir members being securely attached to said window frame and being adapted to store anti-freeze colored liquid, said tubular reservoir members being vertically disposed to either side of said window frame;

decorative conduit members being disposed upon said window panel and being connected to said tubular reservoir members with tubular connectors, said decorative conduit members being arranged in pattern designs including flowers, geometrical shapes, and any child-oriented themes, said decorative conduit members being made of vinyl material and being securely attached upon a front side of said window panel, said tubular connectors being securely disposed at top corners of said window panel and being extended through said window frame and into said tubular reservoir members near top ends thereof, said tubular connectors being securely attached to an upper cross member of said window frame; and pump members being connected to said tubular reservoir members for urging the anti-freeze colored liquid into said decorative conduit members and for drawing the anti-freeze colored liquid from said decorative conduit members, said pump members being generally piston/plunger members being disposed in elongate side members of said window frame and being connected to said tubular reservoir members and being adapted to urge the anti-freeze colored liquid from said tubular reservoir members into said decorative conduit members upon said window panel being in a lowered position and also being adapted to draw the anti-freeze colored liquid from said decorative conduit members into said tubular reservoir members upon said window panel being in a lowered position.

* * * * *